US009748676B2

(12) United States Patent
Han et al.

(10) Patent No.: US 9,748,676 B2
(45) Date of Patent: Aug. 29, 2017

(54) ELECTRICAL CONNECTOR

(71) Applicant: Beijing Sifang Automation Co., Ltd, Beijing (CN)

(72) Inventors: Zaolin Han, Beijing (CN); Guanwen Hu, Beijing (CN); Hui Meng, Beijing (CN); Lixiang Guo, Beijing (CN)

(73) Assignee: Beijing Sifang Automation Co., Ltd, Beijing (CN)

( * ) Notice: Subject to any disclaimer, the term of this patent is extended or adjusted under 35 U.S.C. 154(b) by 0 days.

(21) Appl. No.: 14/917,998

(22) PCT Filed: Nov. 5, 2014

(86) PCT No.: PCT/CN2014/090303
§ 371 (c)(1),
(2) Date: Mar. 10, 2016

(87) PCT Pub. No.: WO2015/035962
PCT Pub. Date: Mar. 19, 2015

(65) Prior Publication Data

US 2016/0226163 A1 Aug. 4, 2016

(51) Int. Cl.
*H01R 9/22* (2006.01)
*H01R 9/24* (2006.01)
(Continued)

(52) U.S. Cl.
CPC ..... *H01R 9/2416* (2013.01); *H01R 9/18* (2013.01); *H01R 9/2491* (2013.01); *H01R 13/748* (2013.01)

(58) Field of Classification Search
CPC ..... H01R 13/748; H01R 9/18; H01R 9/2416; H01R 9/2491
(Continued)

(56) References Cited

U.S. PATENT DOCUMENTS 2,988,634 A * 6/1961 Miskella ..... F21V 17/00 219/520
RE25,446 E * 9/1963 Ustin ..... H01R 9/2408 439/491
(Continued)

FOREIGN PATENT DOCUMENTS

CN 202058906 U 11/2011
CN 102332641 A 1/2012
(Continued)

*Primary Examiner* — Abdullah Riyami
*Assistant Examiner* — Nelson R Burgos-Guntin
(74) *Attorney, Agent, or Firm* — Muirhead and Saturnelli, LLC

(57) ABSTRACT

The present invention relates to an electrical connector, comprising a connector main body (1) and screws (2, 3). The connector main body (1) includes a housing (4), a multi-socket wire connection structure (5), a multi-socket plug-in connection structure (8), and a multi-socket wire disconnection structure (6). The screws (2, 3) are preferably set screws, which comprise a guide structure (9), a thread structure (10), a fall-off prevention structure (11), and a wrenching structure (12). The present invention has advantages of high connection density, ease of wiring connection, high efficiency, being shock-resistant, loosening-proof and reliable, while meeting the IEC 60603-2 standard.

6 Claims, 8 Drawing Sheets

(51) Int. Cl.
*H01R 9/18* (2006.01)
*H01R 13/74* (2006.01)

(58) Field of Classification Search
USPC ..... 439/722, 709, 805, 815, 817, 818
See application file for complete search history.

(56) References Cited

U.S. PATENT DOCUMENTS 4,595,248 A * 6/1986 Brown ..... H01R 12/75 439/721
5,595,505 A * 1/1997 Duke ..... H01R 4/34 439/630
5,713,766 A * 2/1998 Davies ..... H01R 9/2491 439/709
5,741,161 A * 4/1998 Cahaly ..... H01R 12/515 439/637
6,217,356 B1 * 4/2001 Davis ..... H01R 4/245 439/181
6,222,717 B1 * 4/2001 Waas ..... H01R 4/2433 361/119
6,293,830 B1 * 9/2001 Park ..... H01R 9/26 439/709
8,308,516 B2 11/2012 Gassaur et al.
8,998,658 B2 * 4/2015 Borst ..... H01R 9/2425 439/797
2004/0082229 A1 * 4/2004 Bouley ..... H01R 4/4827 439/834
2005/0250389 A1 * 11/2005 Johansen ..... H01R 9/2641 439/709
2006/0030207 A1 * 2/2006 Mertz ..... H01R 13/74 439/547
2006/0258231 A1 * 11/2006 Cox ..... H01R 4/38 439/798
2007/0238303 A1 * 10/2007 Walter ..... H01R 4/4836 438/709
2008/0274645 A1 * 11/2008 Yohn ..... H01R 4/30 439/595
2009/0130919 A1 * 5/2009 Wu ..... H01R 9/2458 439/709
2011/0143578 A1 * 6/2011 Kisic ..... G01R 1/0408 439/482
2012/0077355 A1 * 3/2012 Borst ..... H01R 12/7064 439/55
2012/0092835 A1 * 4/2012 Miller ..... H01R 4/5008 361/724
2013/0023165 A1 * 1/2013 Sasahara ..... F16B 43/00 439/805
2013/0309917 A1 * 11/2013 Wu ..... H01R 4/302 439/815
2015/0093943 A1 * 4/2015 Nagasaki ..... H01R 4/4818 439/817
2016/0020543 A1 * 1/2016 Tedeschi ..... H01R 13/42 439/733.1
2016/0028170 A1 * 1/2016 Hyder ..... H01R 9/2416 439/462

FOREIGN PATENT DOCUMENTS

CN 202189924 U 4/2012
CN 103441359 A 12/2013
JP 2013-115006 A 6/2013

* cited by examiner

ELECTRICAL CONNECTOR

FIELD OF THE INVENTION

The present invention may be used in the electrical power industry, electronics industry, electrical industry and especially the industrial control industry.

BACKGROUND OF THE INVENTION

Prior art electrical connector wiring is generally screw connection or pull-back spring connection. Screw connection has an advantage of reliability but disadvantages of large space occupation, slow wiring, low efficiency, and occasional screw looseness or failure. Pull-back spring connection has advantages of small space occupation and fast wiring but disadvantage of needing special tools for wire disconnection.

SUMMARY OF THE INVENTION

An object of the present invention is to avoid the above-mentioned existing deficiencies and to provide a novel electrical connector. The present invention features high connection density, ease of wiring connection, high efficiency, being shock-resistant, loosening-proof and reliable, while meeting the IEC 60603-2 standard. The present invention may be used in several combined applications based on actual needs.

Technical Scheme of the Present Invention

An electrical connector, comprising a connector main body and screws, wherein:

the connector main body including a housing, a multi-socket wire connection structure, a multi-socket plug-in connection structure, a multi-socket wire disconnection structure and a screw mounting structure;

the wire connection structure, the plug-in connection structure and the wire disconnection structure are arranged in the housing, wherein the wire connection structure and the wire disconnection structure are mounted in a front opening of the housing, the wire connection structure and the wire disconnection structure for a same socket are arranged adjacent to the outside of a same belleville spring, and the wire connection structure has an opening for receiving an accessed conductor, which is jammed by spring force of the belleville spring; the wire disconnection structure is arranged as a button; the belleville spring is jacked by pressing the wire disconnection structure so as to release the conductor connected to the wire connection structure;

the plug-in connection structure consists of a spring clip, which forms an opening located behind the housing; the spring clip of the plug-in connection structure and the belleville spring at one side of the wire connection structure are integrated for a same socket; the spring clip of the plug-in connection structure has a guide and rounded accessible structure facilitating to plug-in and plug-out; the plug-in connection structure is used for plugging of pins of terminals into the electrical connector;

the screw mounting structure is arranged at both ends of the housing, and has a screw hole matching the screws; the screw mounting structure may either be integrated with the housing, or be made as an independent part mounted onto the housing.

The housing of the connector main body is generally made of non-metallic materials such as plastic. This makes it have such advantages as good processing performance, mechanical performance, and electrical insulation performance. The wire connection structure generally made of metal materials is used for accessing conductors and is like a belleville spring structure. The wire connection structure may or may not be subjected to heat treatment and surface treatment depending on material selection, service conditions, etc. The plug-in connection structure is generally made of metal materials, and the plug-in connection structure and the wire connection structure are electrically conductive for a same socket. In order to reduce complexity and cost of the electrical connector, the plug-in connection structure is usually integrated with the wire connection structure as one part and mounted within the housing of the connector main body.

The set screws are generally made of metal materials. They may or may not be subjected to heat treatment and surface treatment depending on material selection, service conditions, etc.

The specific use may be flexible and variable according to needs.

The present invention features high connection density, ease of wiring connection, and high efficiency, while being shock-resistant, loosening-proof and reliable, and meeting the IEC 60603-2 standard.

DETAILED DESCRIPTION OF THE EMBODIMENTS

The technical scheme of the present invention is now further described in detail in combination with the drawings.

Figure 1:
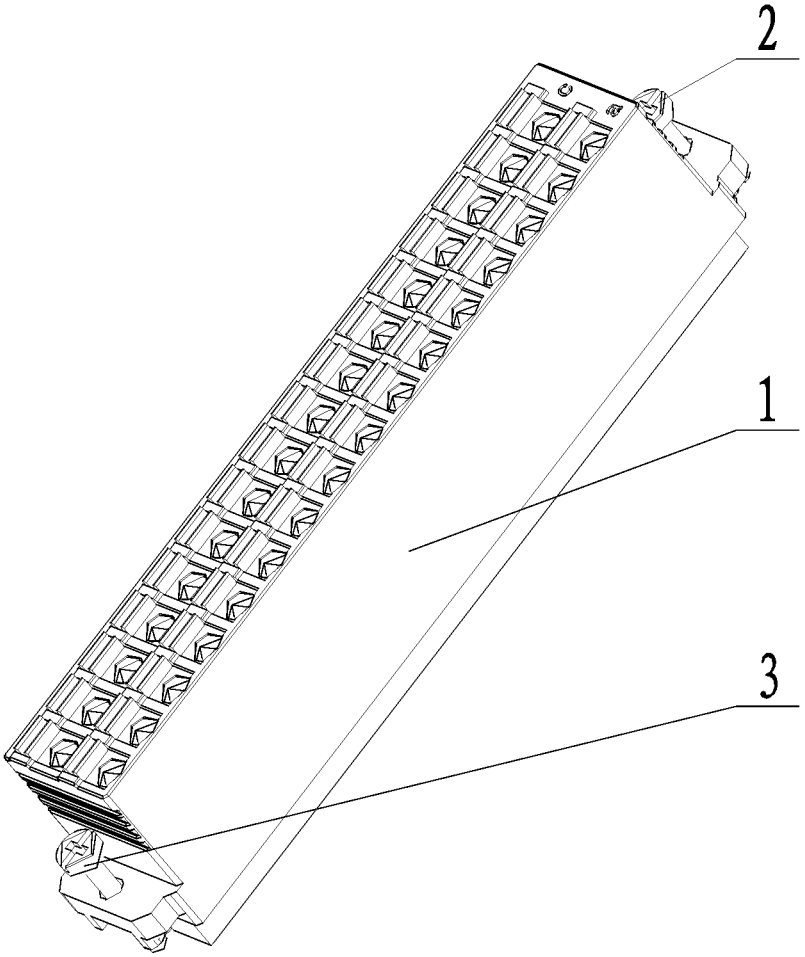
FIG. 1 is a schematic diagram of an electrical connector according to the present invention.

As shown in FIG. 1, an electrical connector comprising a connector main body 1 and set screws 2 and 3 is illustrated. There is a screw mounting structure 7 respectively at both ends of the connector main body 1. With the screw mounting structure 7, the set screws 2 and 3 fix the electrical connector with other matched electrical connectors. The housing of the connector main body 1 is generally made of non-metallic materials such as plastic, thus it has such advantages as good processing performance, mechanical performance, and electrical insulation performance.

The screw mounting structure 7 is a plate part protruding from the main body 1. Screw holes matching with the set screws 2 and 3 are provided on the plate part. The set screws 2 and 3 that can pass through the screw holes fix the electrical connector at a desired position. The screw mounting structure 7 may either be integrated with the housing 4, or be made as an independent part to be mounted on the housing 4.

Figure 2:
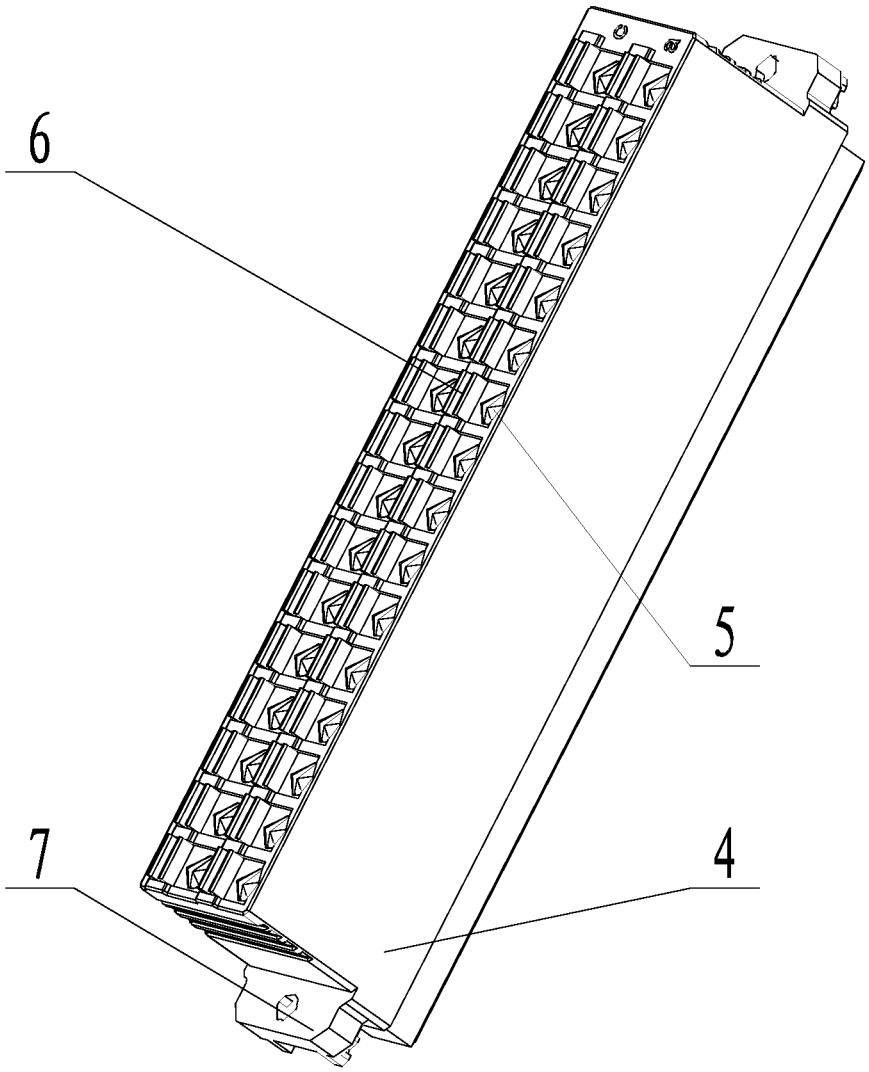
FIG. 2 is a schematic diagram of a connector main body according to the present invention.
Figure 3:
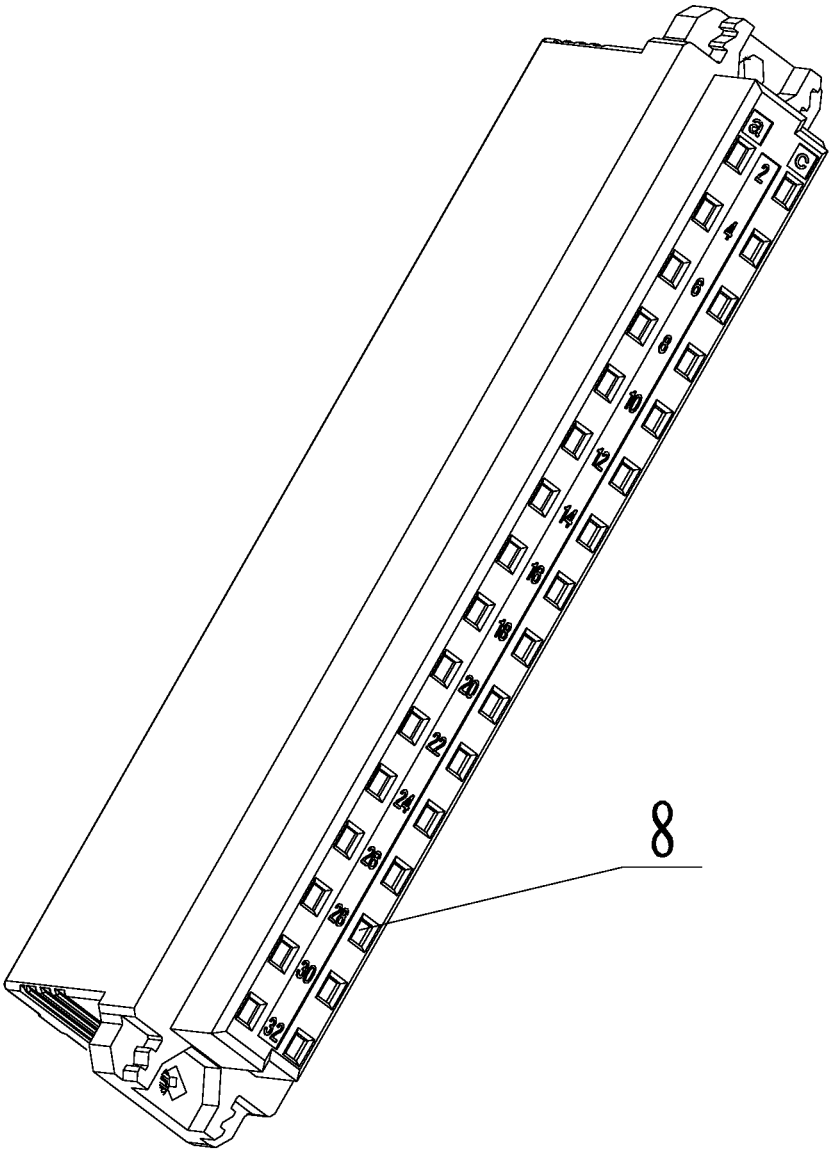
FIG. 3 is another schematic diagram of the connector main body (opposite to the side as shown in FIG. 2) according to the present invention.
Figure 8:
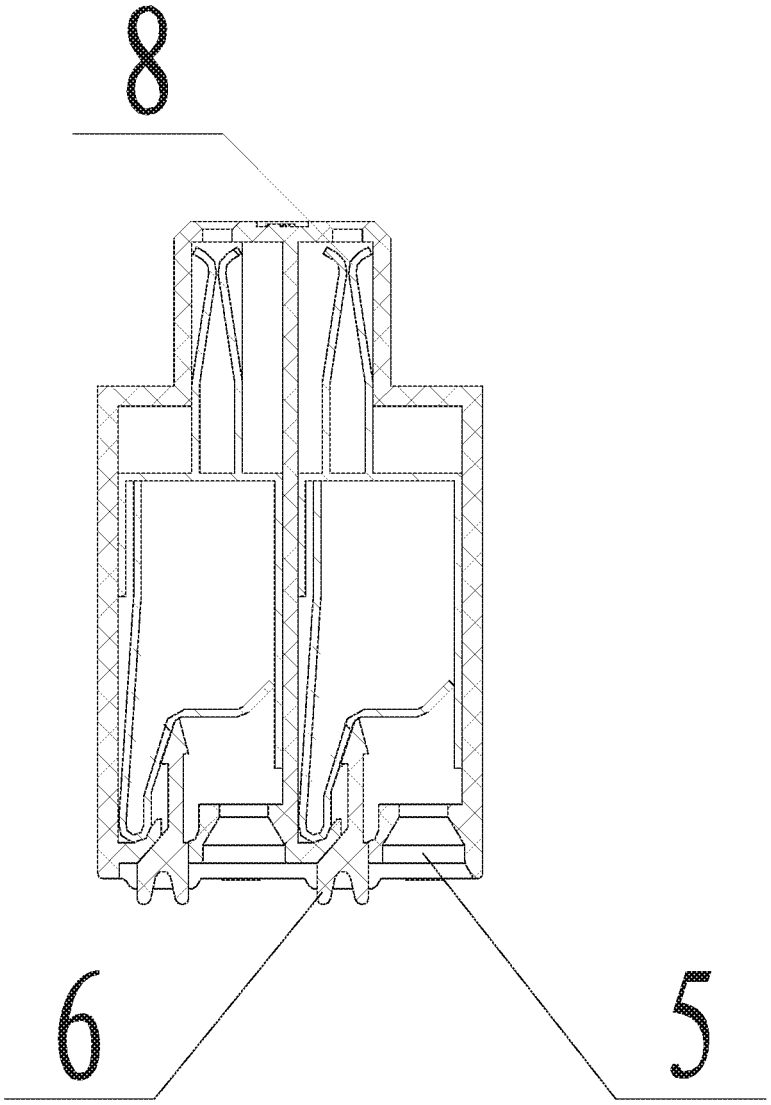
FIG. 8 is a schematic diagram of cross-section of an electrical connector according to the present invention.

As shown in FIG. 2, FIG. 3 and FIG. 8, the connector main body 1 includes a housing 4, in which a wire connection structure 5 (preferably with total 32 sockets, and other number of sockets may be provided according to actual needs), a plug-in connection structure 8 (preferably with total 32 sockets, and other number of sockets may be provided according to actual needs) and a wire disconnection structure 6 (preferably with total 32 sockets, and other number of sockets may be provided according to actual needs) are mounted. Two set screw mounting structures 7 are provided at both ends of the housing 4. The plug-in connection structure 8 (with 32 sockets) allows a contact pin with a sectional dimension of 1 mm×1 mm.

FIG. 2 shows a front schematic diagram of the connector main body 1. The front and the back of the housing 4 take a shape like an opening. The wire connection structure 5 and the wire disconnection structure 6 are mounted in the front opening of the housing 4. In an embodiment of the present application, both the wire connection structure 5 and the wire disconnection structure 6 are of a 32-socket structure. It is understood that it is only a preferred embodiment to provide a 32-socket wire connection structure and a 32-socket wire disconnection structure instead of a limitation to the invention. The skilled in the art may select the wire connection structure and the wire disconnection structure with an appropriate number of sockets according to needs.

FIG. 3 shows the back structure of the connector main body 1. The plug-in connection structure 8 is mounted in the back opening of the housing 4. In an embodiment of the present application, the plug-in connection structure 8 is of a 32-socket structure. It is understood that it is only a preferred embodiment to provide a 32-socket plug-in connection structure instead of a limitation to the present invention. The skilled in the art may select the plug-in connection structure with an appropriate number of sockets according to needs.

FIG. 8 shows a positional relationship among the wire connection structure 5, the plug-in connection structure 8 and the wire disconnection structure 6. The wire connection structure 5 is of a belleville spring structure. The wire connection structure 5 and the plug-in connection structure 8 are electrically conductive for a same socket and integrated. The wire connection structure 5 and the wire disconnection structure 6 are mounted in the front opening of the housing 4. The wire connection structure 5 and the wire disconnection structure 6 are arranged adjacent to the outside of a same belleville spring for a same socket, and the wire connection structure 5 has an opening for receiving an accessed conductor, which is jammed by spring force of the belleville spring; the wire disconnection structure 6 is arranged as a button; by pressing the wire disconnection structure 6, the belleville spring will be jacked to release the conductor connected to the wire connection structure 5.

Two elastic contact chips forming a spring clip are used in the plug-in connection structure 8. The elastic contact chips are arc-shaped, and they may be tightly pressed at one point under their own elastic force. The spring clip forms an opening located behind the housing 4. The plug-in connection structure 8 has a guide and rounded accessible structure facilitating to plug-in and unplug, so that it is easy to plug in and unplug the pins of other terminals.

The wire disconnection structure 6 is generally made of non-metallic materials such as plastic. The wire connection structure 5 is generally made of metal material and it may or may not be subjected to heat treatment and surface treatment depending on material selection, service conditions, etc. The plug-in connection structure 8 is generally made of metal materials, and the plug-in connection structure 5 and the wire connection structure 8 are electrically conductive for a same socket. In order to reduce complexity and cost of the electrical connector, the plug-in connection structure is usually integrated with the wire connection structure 5 as one part and mounted within the housing 4 of the connector main body 1. The minimum wiring spacing between the wire connection structure 5 and the plug-in connection structure 8 is 5.08 mm.

During wiring, solid conductors or stranded conductors with cold cable lugs are directly inserted into the holes of the wire connection structure 5. Since the conductors are jammed by the spring force of the belleville spring and the conductors are under the influence of the sharp corner of the fracture of the belleville spring, the inserted conductors will not fall off by itself, and they only can be pulled down with certain a pulling force. When disconnecting the conductors, it is only required to use a slotted screwdriver to slightly press the wire disconnection structure 6, which then jacks the belleville spring to release the conductors so that the conductors can be disconnected easily.

Figure 4:
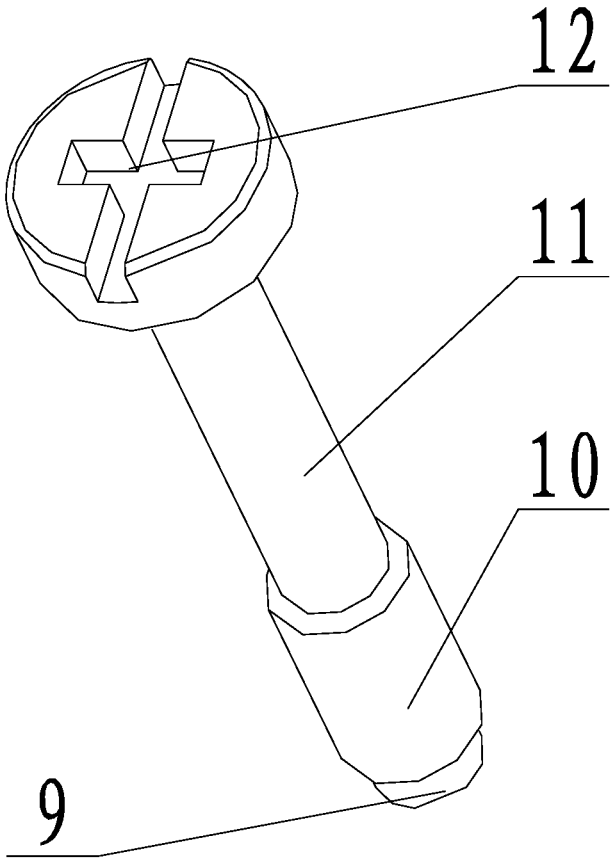
FIG. 4 is a schematic diagram of set screws used in the present invention.

As shown in FIG. 4, a set screw comprises a guide structure 9, a thread structure 10, a fall-off prevention structure 11 and a wrenching structure 12. At the lower part of the set screw is the guide structure 9, which plays an orientation role through a chamfer. The upper part of the guide structure 9 is adjacent to the thread structure 10. The diameter of a part of the shaft of the thread structure 10 is greater than the diameters of the shafts of the guide structure 9 and the fall-off prevention structure 11. The outside of the thread structure 10 is designed with external thread, which fits internal thread on the screw mounting structure 7 of the connector main body 1. The upper part of the thread structure 10 is adjacent to the fall-off prevention structure 11. The shaft diameter of the fall-off prevention structure 11 is smaller than that of the thread structure 10. The upper part of the fall-off prevention structure 11 is the wrenching structure 12, which is provided at the upper end of the set screw. The lower part of the wrenching structure 12 is connected to the upper part of the fall-off prevention structure 11. The upper surface of the wrenching structure 12 is provided with a "+" slot or a "–" slot for a screwdriver to wrench screws.

In FIG. 1, the set screws 2 and 3 are generally made of metal materials. They may or may not be subjected to heat treatment and surface treatment depending on material selection, service conditions, etc.

Figure 7:
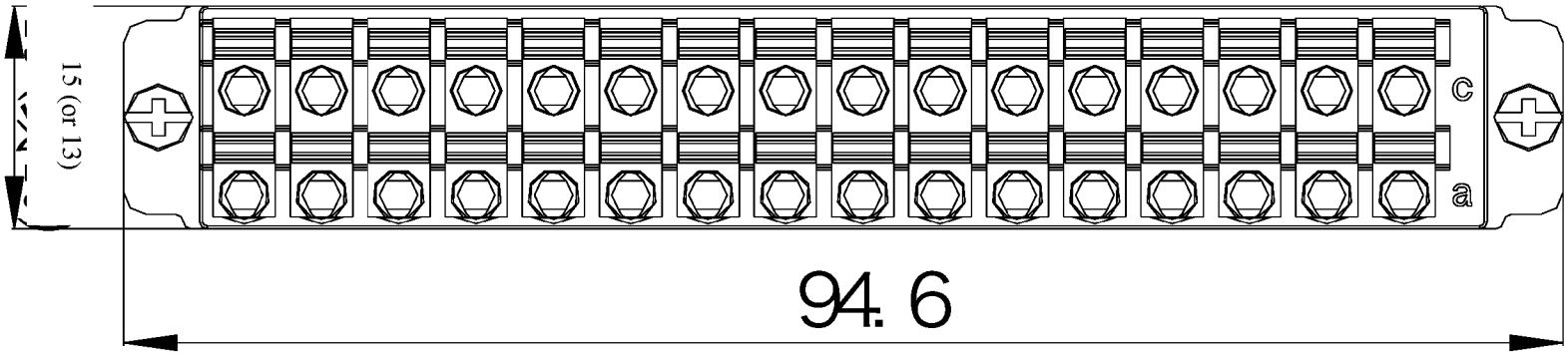
FIG. 7 is a schematic diagram of appearance of an electrical connector according to the present invention.

As shown in FIG. 7, an electrical connector of the present invention is made with dimensions of 94.6 mm×15 mm or 94.6 mm×13 mm.

There are several kinds of specific use, including:

1. As shown in FIG. 1, the set screws 2 and 3 are mounted in the corresponding holes at both ends of the connector main body 1 to fix the electrical connector according to the present invention with other matched electrical connectors. The set screws 2 and 3 are of a fall-off prevention structure.

Figure 5:
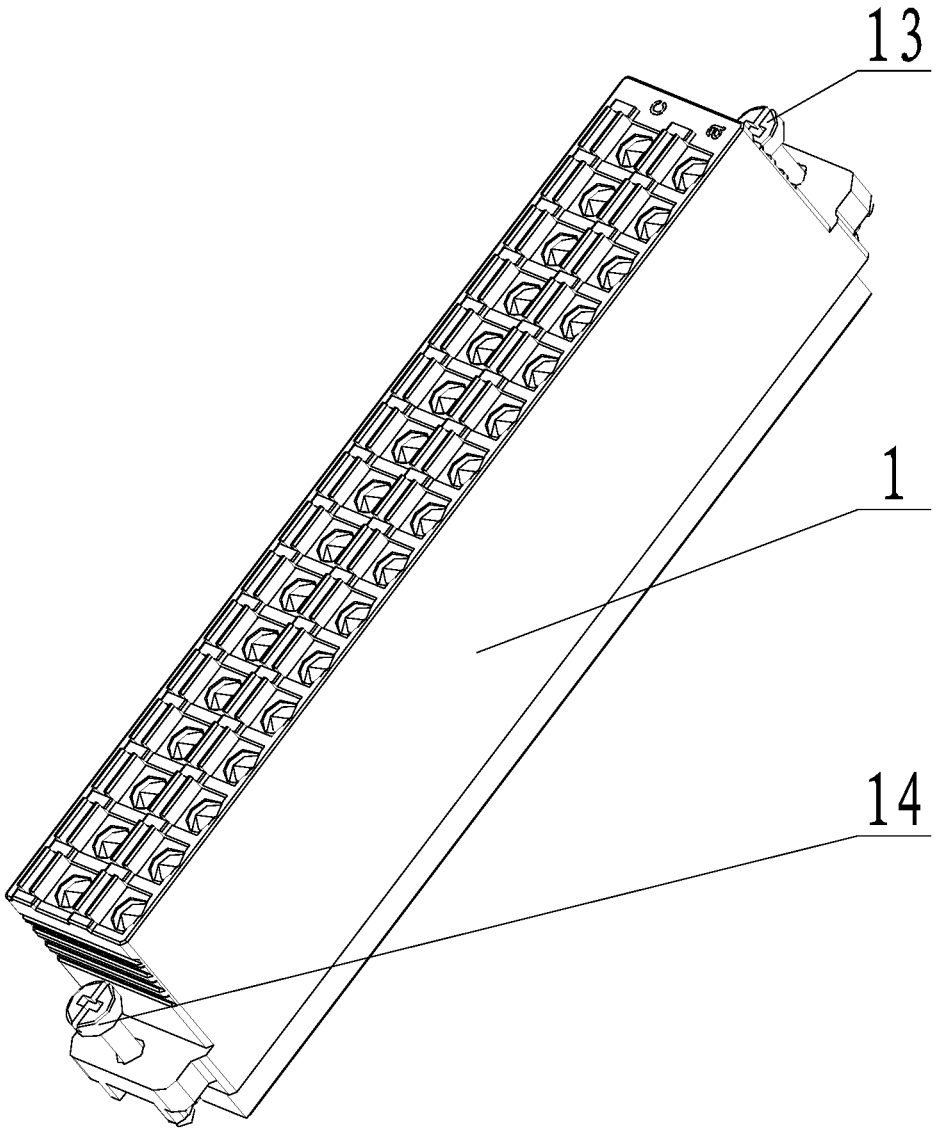
FIG. 5 is a schematic diagram of an electrical connector fixed with plain screws.

2. As shown in FIG. 5, the set screws 2 and 3 mentioned in the present invention are not mounted at both ends of the connector main body 1; instead, other screws 13 and 14 are used to fix the electrical connector according to the present invention with other matched electrical connectors.

Figure 6:
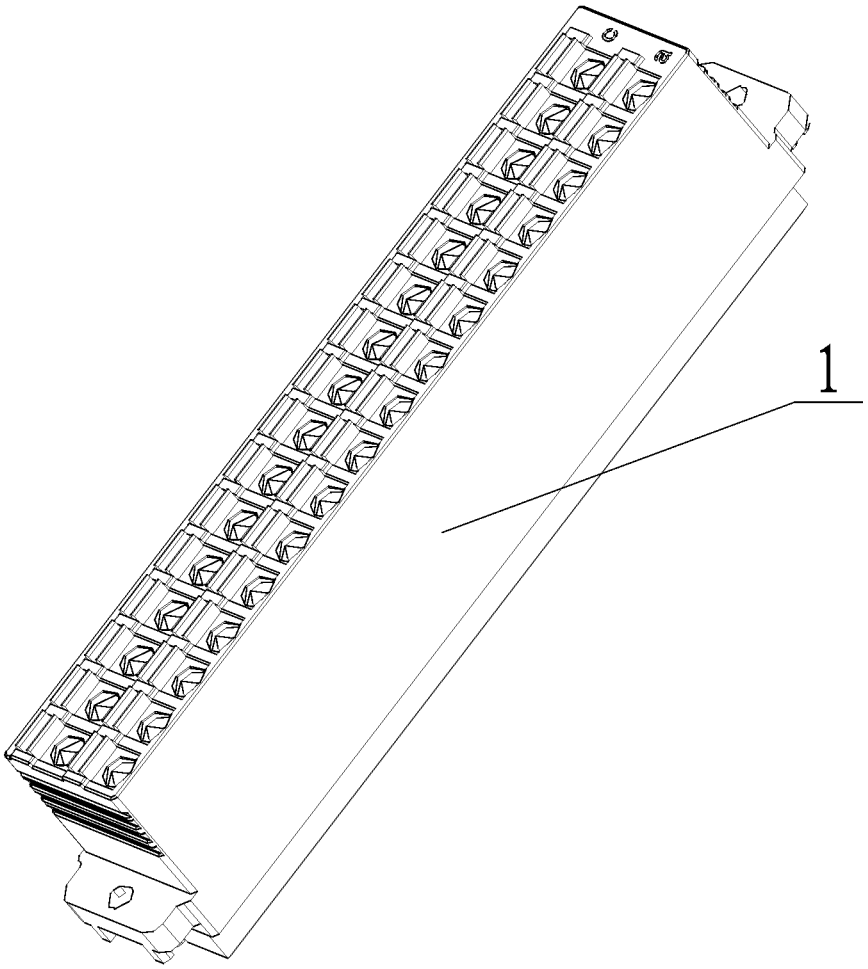
FIG. 6 is a schematic diagram of an electrical connector to which screw fixation is not applicable.

3. As shown in FIG. 6, no screws are mounted at both ends of the connector main body 1; instead, the electrical connector according to the present invention is directly plugged into other matched electrical connectors, and the electrical connectors are fixed by other means.

The use of the electrical connector according to the present invention may be flexible and variable as per demands.

The invention claimed is:

1. An electrical connector, comprising a connector main body and screws, characterized in that:

the connector main body including a housing, a multi-socket wire connection structure, a multi-socket plug-in connection structure, a multi-socket wire disconnection structure and a screw mounting structure;

the wire connection structure, the plug-in connection structure and the wire disconnection structure are arranged in the housing, wherein the wire connection structure and the wire disconnection structure are mounted in a front opening of the housing, the wire connection structure and the wire disconnection structure for a same socket are arranged adjacent to the outside of a same belleville spring, and the wire connection structure has an opening for receiving an accessed conductor, which is jammed by spring force of the belleville spring; the wire disconnection structure is arranged as a button; the belleville spring is jacked by pressing the wire disconnection structure so as to release the conductor connected to the wire connection structure;

the plug-in connection structure consists of a spring clip, which forms an opening located behind the housing; the spring clip of the plug-in connection structure and the belleville spring at one side of the wire connection structure are integrated for a same socket; the spring clip of the plug-in connection structure has a guide and rounded accessible structure facilitating to plug-in and plug-out; the plug-in connection structure is used for plugging of pins of terminals into the electrical connector;

the screw mounting structure is arranged at both ends of the housing, and has a screw hole matching the screws; the screw mounting structure may either be integrated with the housing, or be made as an independent part mounted onto the housing.

2. The electrical connector according to claim 1, characterized in that:

the screws are set screws, and the set screws comprise a guide structure, a thread structure, a fall-off prevention structure, and a wrenching structure;

the guide structure located at the lower portion of the set screws, which is chamfered or rounded;

the upper part of the guide structure is adjacent to the thread structure of the screw; the diameter of a part of the shaft of the thread structure is greater than the diameters of the shafts of the guide structure and the fall-off prevention structure; the thread structure is designed with external threads, which fit internal threads on the screw mounting structure of the connector main body;

the upper part of the thread structure is adjacent to the fall-off prevention structure; the shaft diameter of the fall-off prevention structure is smaller than that of the thread structure;

the upper part of the fall-off prevention structure is the wrenching structure, which is provided at the upper end of the set screw; the lower part of the wrenching structure is connected to the upper part of the fall-off prevention structure; the upper surface of the wrenching structure is provided with a "+" slot or a "−" slot for a screwdriver to wrench screws.

3. The electrical connector according to claim 1, characterized in that the electrical connector may include only a connector main body.

4. The electrical connector according to claim 1, characterized in that the wire connection structure, the plug-in connection structure and the wire disconnection structure have 32 sockets respectively.

5. The electrical connector according to claim 4, characterized in that the plug-in connection structure and the wire connection structure are electrically conductive for a same socket.

6. The electrical connector according to claim 2, characterized in that the wire connection structure, the plug-in connection structure and the wire disconnection structure have 32 sockets respectively.

* * * * *